US006915575B2

(12) United States Patent
Cerutti

(10) Patent No.: US 6,915,575 B2
(45) Date of Patent: Jul. 12, 2005

(54) CUTTING TOOL

(75) Inventor: Roberto Cerutti, Somaglia (IT)

(73) Assignee: Vicom S.r.l., Somaglia (IT)

( * ) Notice: Subject to any disclaimer, the term of this patent is extended or adjusted under 35 U.S.C. 154(b) by 0 days.

(21) Appl. No.: 10/348,302

(22) Filed: Jan. 21, 2003

(65) Prior Publication Data

US 2003/0140498 A1 Jul. 31, 2003

(30) Foreign Application Priority Data

Jan. 28, 2002 (EP) ..... 02425032

(51) Int. Cl.[7] ..... A45D 29/02
(52) U.S. Cl. ..... 30/28; 30/186
(58) Field of Search ..... 30/28, 262, 186, 30/254, 266, 271, 258, 260, 261; 76/106.5, 104.1

(56) References Cited

U.S. PATENT DOCUMENTS

| | | | | | |
|---|---|---|---|---|---|
| 287,437 | A | * | 10/1883 | Hubbard | 30/186 |
| 329,133 | A | * | 10/1885 | Broadbooks | 30/186 |
| 532,509 | A | * | 1/1895 | Whiting | 30/186 |
| 673,014 | A | * | 4/1901 | Broadbooks | 30/186 |
| 980,861 | A | * | 1/1911 | Blake | 30/186 |
| 1,168,051 | A | * | 1/1916 | Berbard | 30/186 |
| 1,336,464 | A | * | 4/1920 | Ircnside | 30/186 |
| 2,310,959 | A | * | 2/1943 | James | 30/186 |
| 4,031,621 | A | | 6/1977 | Arlett | 30/262 |
| 4,268,963 | A | * | 5/1981 | Harrison | 30/262 |
| 4,947,553 | A | | 8/1990 | Bendickson et al. | 30/262 |
| 4,980,975 | A | * | 1/1991 | Hodson | 30/262 |
| 5,179,783 | A | * | 1/1993 | Melter | 30/262 |
| 5,214,854 | A | * | 6/1993 | Mennicken | 30/186 |
| 5,367,774 | A | * | 11/1994 | Labarre et al. | 30/262 |
| 5,377,564 | A | * | 1/1995 | Erlich | 81/9.44 |
| 5,426,857 | A | * | 6/1995 | Linden | 30/262 |
| 5,987,755 | A | | 11/1999 | Shih | 30/262 |
| 6,418,626 | B1 | * | 7/2002 | Jang | 30/262 |
| 6,446,344 | B1 | * | 9/2002 | Gontar | 30/262 |
| 6,829,828 | B1 | * | 12/2004 | Cech et al. | 30/250 |
| 2003/0061715 | A1 | * | 4/2003 | Heck et al. | 30/186 |

FOREIGN PATENT DOCUMENTS

| | | | | |
|---|---|---|---|---|
| DE | 196 52 389 | A1 | 3/1998 | A01G/3/02 |
| EP | 0 631 718 | A1 B1 | 7/1996 | A01G/3/02 |
| FR | 2 748 893 | A3 | 11/1987 | A01G/3/02 |
| GB | 2 309 926 | A | 8/1997 | A01G/3/02 |

OTHER PUBLICATIONS

European Search Report Dated Jul. 24, 2002; Application No. 02425032.6.

* cited by examiner

*Primary Examiner*—Allan N. Shoap
*Assistant Examiner*—Ghassem Alie
(74) *Attorney, Agent, or Firm*—Husch & Eppenberger, LLC; Robert C. Haldiman

(57) ABSTRACT

The cutting tool, in particular nail clippers, comprise two elongated members hinged around an axis (A), wherein each member is provided with an actuating arm and a cutting edge; the cutting edges of the two elongated members face each other so as to reciprocally co-operate for cutting when they are moved towards one another by the action of approach on the actuating arms. The tool also comprises elastic means for biasing the elongated members towards a diverging condition in which the two actuating arms and the two cutting edges are spaced from one another, and retaining means for holding the elongated members in a closed condition, in contrast with the elastic means. According with the present invention, the retaining means comprises a threaded pin, which is adjustably inserted in screwing engagement in a threaded hole formed through a first of the two elongated members and is provided with a manually actuable head and with an end opposed the head, in front contact engagement into a retaining seat formed in the second of the two elongated members.

7 Claims, 2 Drawing Sheets

CUTTING TOOL

This application claims priority to European Application Number 02425032.6.

The present invention relates to a cutting tool, in particular, to nail clippers.

Tools of this type are known, that include two elongated members hinged around an axis, wherein each member is provided with an actuating arm and a cutting edge; the cutting edges of the two elongated members face each other so as to reciprocally co-operate for cutting when they are moved towards one another by the action of approach on the actuating arms. There are also provided elastic means for biasing the elongated members towards a diverging condition in which the two actuating arms and the two cutting edges are spaced from one another, and retaining means for holding the elongated members in a closed condition, in contrast with the elastic means.

The retaining means keeps the tool closed when at rest, thereby preventing the tool—if left by itself—from having the cutting edges in an exposed position, so as to constitute a potential danger for someone who could inadvertently touch such edges.

The most widespread retaining means typically comprise a variedly shaped lever that hooks between the actuating arms, thus preventing them from diverging.

However, such retaining means are relatively difficult to be actuated. In fact, the tool is often left in diverging and thereby dangerous condition. Moreover, known retaining means are not provided with intermediate positions, that is, such as to allow adjusting the maximum diverging condition. Such adjustment would be particularly useful above all to facilitate use for users with small hands, for whom it is currently difficult to grip the tool when in diverging condition.

Object of the present invention is to provide a tool with improved retaining means, which allows easy actuation, preferably allowing the adjustment of the maximum diverging condition.

Accordingly, the present invention relates to a cutting tool, preferably nail clippers, comprising two elongated members hinged around an axis, wherein each elongated member is provided with an actuating arm and a cutting edge, wherein the cutting edges of the two elongated members face each other so as to reciprocally co-operate for cutting when they are moved towards one another by the action of approach on the actuating arms, also comprising elastic means for biasing the elongated members towards a diverging condition in which the two actuating arms and the two cutting edges are spaced from one another, and retaining means for holding the elongated members in a closed condition, in contrast with the elastic means, characterised in that the retaining means comprises a threaded pin, which is adjustably inserted in screwing engagement into a threaded hole formed through one of the two elongated members, and is provided with a manually actuable head and with an end opposed the head, in front contact engagement in a retaining seat formed into the second of the two elongated members.

The threaded pin head is easily actuable in rotation by the user, who can thus adjust the position of the pin into its hole; pressing the pin thoroughly into the hole locks the two actuating arms due to the front engagement of the same pin into its seat.

Preferably, the retaining seat is a groove linearly extending as an arc, the groove having an inclined bottom, so as to have a variable depth between a maximum, at one of its end portions that is positioned in front of the threaded hole when the elongated members are in closed condition, and a minimum, at one of its end portions that is positioned in front of the threaded hole when the elongated members are in a totally diverging condition.

This solution allows adjusting the maximum diverging condition of the elongated members: the more the pin is pushed thoroughly into the hole, and thus into the seat, the less the possibilities of the elongated members of diverging.

Preferably, in order to facilitate manual actuation, the threaded pin head is knurled.

Preferably, the threaded pin is substantially parallel to the hinging axis. In this way, the holding action efficacy is maximum, since the relative motion between pin and retaining seat is perpendicular to the pin axis itself.

The two elongated members can be reciprocally hinged in various ways, so as to define first-, second- or third-class levers. Preferably, the two elongated members are crossed with one another at the hinging axis, each elongated member having an operating arm opposed the actuating arm with respect to the hinging axis, the cutting edges being formed onto such operating arms. The tool thus has a first-class lever structure, particularly effective for cutting.

Also the elastic means can be of various types, provided that it ensures the action of return of the elongated members towards the diverging condition. Preferably, the elastic means comprises a spring compressed between facing portions of the actuating arms. This solution ensures the utmost simplicity and efficacy.

Such spring preferably has opposed ends housed into respective seats formed in the actuating arms, so as to ensure a safe arrangement.

Further features and advantages of the present invention will appear more clearly from the following description of a preferred embodiment, made with reference to the attached drawings. In such drawings.

Figure 2:
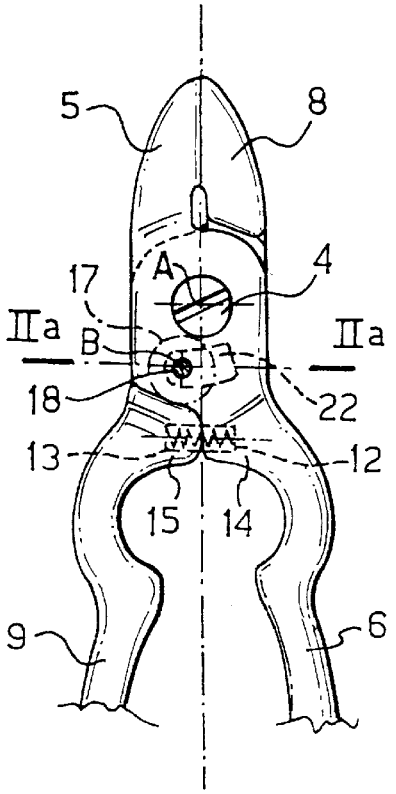
FIG. 2 is a partial view of the nail clippers of FIG. 1, in closed condition.
Figure 2A:
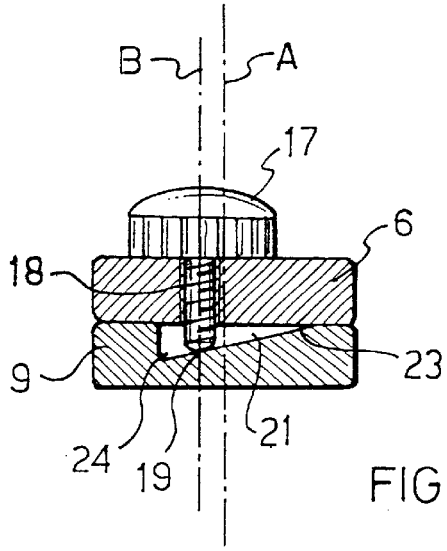
Figure 3:
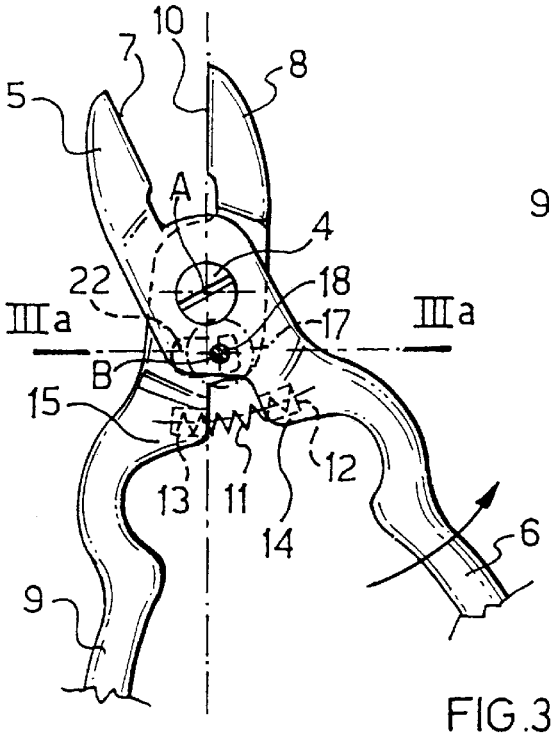
FIG. 3 is a partial view of the nail clippers of FIG. 1, in diverging condition.
Figure 3A:
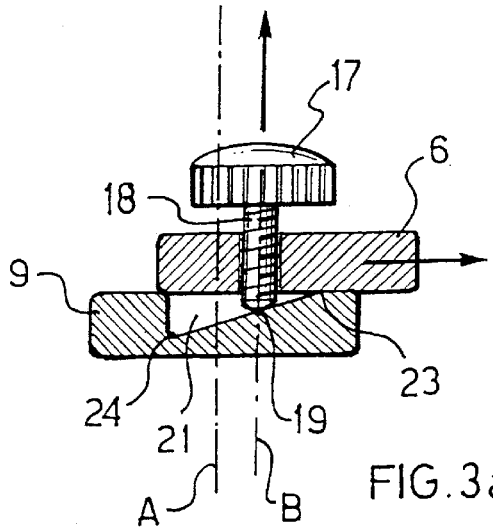

FIGS. 2*a* and 3*a* are partial sections respectively drawn along lines IIa—IIa and IIIa—IIIa of FIGS. 2 and 3.

In the figures, reference numeral 1 denotes a cutting tool, in particular nail clippers. Nail clippers 1 comprise two elongated members 2 and 3, crossing each another and hinged along an axis A through a screw 4, secured in an in se known way. Member 2 comprises an operating arm 5 and an actuating arm 6, at opposed sides with respect to the hinging screw 4; the operating arm 5 comprises a cutting edge 7. Similarly, member 3 comprises an operating arm 8 and an actuating arm 9, at opposed sides with respect to the hinging screw 4; the operating arm 8 comprises a cutting edge 10. Cutting edges 7 and 10 are opposed to one another, so as to allow the cutting action of nail clippers 1; the two actuating arms 6 and 9 are opposed to one another as well, so as to allow handling nail clippers 1.

Nail clippers 1 further comprise elastic means for biasing the elongated members 2 and 3 towards a diverging condition (FIGS. 1, 3 and 3*a*) wherein the two actuating arms 6 and 9 and the two cutting edges 7 and 10 are spaced from one another. Such elastic means comprises, for example, a helical spring 11, compressed between seats 12 and 13 provided in portions 14 and 15 of the actuating arms 6 and 9, which are close to axis A, but sufficiently spaced from it to ensure a sufficient lever arm for the operation of spring 11.

Nail clippers 1 further comprise retaining means for holding the elongated members 2 and 3 into a closed condition in contrast with spring 11. Such retaining means comprises a pin 16, having a knurled head 17, a threaded stem 18 and an end 19 opposed to head 17; pin 16 is adjustably inserted in screwing engagement into a threaded hole 20 formed in the elongated member 2, and its end 19 engages frontally into a seat 21 formed in the other elongated member 3, in front of hole 20. Seat 21 is a groove which linearly extends as an arc and has an inclined bottom 22, with a variable depth between a minimum (at an end portion 23 of seat 21 that is placed in front of the threaded hole 20 when the elongated members 2 and 3 are in totally diverging condition) and a maximum (at an end portion 24 of seat 21 that is placed in front of the threaded hole 20 when the elongated members 2 and 3 are in closed condition).

The end 19 of pin 16 is adjustably protruding from hole 20, towards seat 21; such adjustment can be obtained by simply acting in rotation on the knurled head 17.

Figure 1:
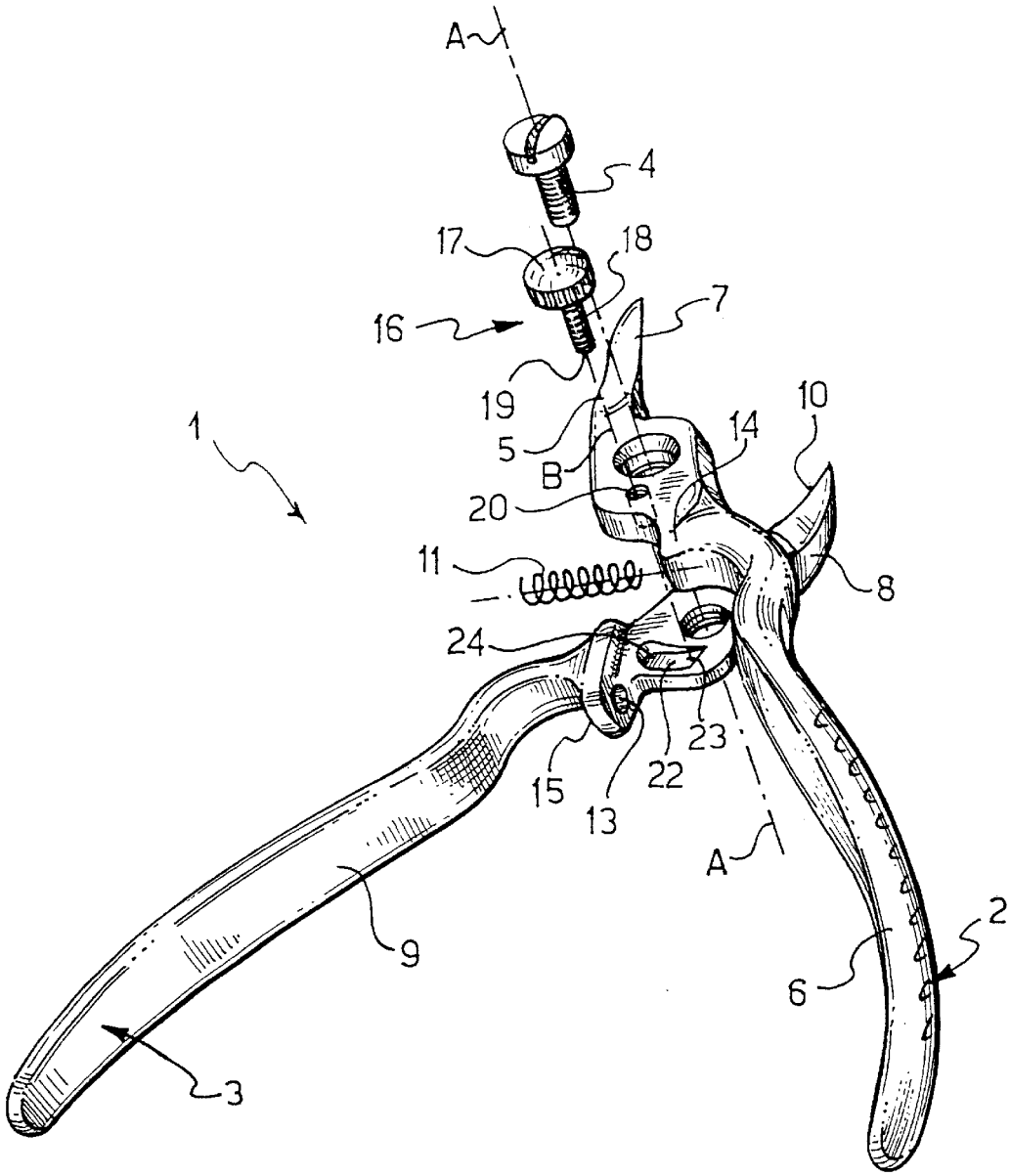
FIG. 1 is a partially exploded perspective view of a nail clipping tool according to the invention.

In use, the two elongated members 2 and 3 can take a closed condition (FIGS. 2 and 2*a*), or a diverging condition in a more or less marked way (FIGS. 1, 3, 3*a*). In closed condition, the cutting edges 7 and 10 are in substantial contact, thus determining the cutting action. In diverging condition, the two arms 6 and 9 can be more or less spaced from one another, according to the position of pin 16: the more pin 16 protrudes from hole 20 into seat 21, the closer the two arms 6 and 9. When at the limit, with pin 16 at the maximum protrusion, the two arms 6 and 9 are kept locked in closed position.

Thus, nail clippers 1 achieve the aforementioned object, allowing both easy closure and adjustment of the diverging condition of arms 6 and 9, everything by the simple manual actuation of pin 16.

What is claimed is:

1. A cutting tool, comprising two elongated members hinged around an axis (A), wherein each member is provided with an actuating arm and a cutting edge, wherein the cutting edges of the two elongated members face each other so as to reciprocally co-operate for cutting when they are moved towards one another by the action of approach on the actuating arms, also comprising elastic means for biasing the elongated members towards a diverging condition in which the two actuating arms and the two cutting edges are spaced from one another, and a retainer holding the elongated members in a closed condition, in contrast with the elastic means, said cutting tool further comprising:

the retainer comprises a threaded pin, the threaded pin being adjustably inserted in screwing engagement into a threaded hole formed into a first of the two elongated members, and the threaded pin having a manually actuable head and with an end opposed to the head, in front contact engagement in a retaining seat formed into the second of the two elongated members; and wherein the retaining seat is a groove linearly extending as an arc, the groove having an inclined bottom so as to have a variable depth between a maximum, at one of its end portions that is positioned in front of the threaded hole when the elongated members are in a closed condition, and a minimum, at one of its end portions that is positioned in front of the threaded hole when the elongated members are in a completely diverging condition.

2. The cutting tool according to claim 1 wherein the head of the threaded pin is knurled.

3. The cutting tool according to claim 1 wherein the threaded pin is substantially parallel to the hinging axis.

4. The cutting tool according to claim 1 wherein the two elongated members are crossed with one another at the hinging axis (A), each elongated member having an operating arm opposed to the actuating arm with respect to the hinging axis (A), the cutting tool being formed onto such operating arms.

5. The cutting tool according to claim 1 wherein the elastic means comprises a spring compressed between facing portions of the actuating arms.

6. The cutting tool according to claim 5 wherein the spring has opposed ends housed into respective seats formed in the actuating arms.

7. The cutting tool according to claim 1 wherein the cutting tool comprises a nail clippers.

* * * * *